US007220109B2

(12) United States Patent
Kultgen

(10) Patent No.: US 7,220,109 B2
(45) Date of Patent: May 22, 2007

(54) PUMP CYLINDER SEAL

(75) Inventor: Raymond J. Kultgen, Glenbeulah, WI (US)

(73) Assignee: Thomas Industries, Inc., Sheboygan, WI (US)

( * ) Notice: Subject to any disclaimer, the term of this patent is extended or adjusted under 35 U.S.C. 154(b) by 185 days.

(21) Appl. No.: 10/995,715

(22) Filed: Nov. 22, 2004

(65) Prior Publication Data

US 2005/0074351 A1 Apr. 7, 2005

Related U.S. Application Data

(62) Division of application No. 10/338,950, filed on Jan. 8, 2003, now Pat. No. 6,832,900.

(51) Int. Cl.
*F16J 15/00* (2006.01)
*F04B 39/12* (2006.01)

(52) U.S. Cl. ..... 417/571; 277/628; 277/642; 417/273

(58) Field of Classification Search ..... 277/590, 277/591, 628, 639, 641, 642; 417/569
See application file for complete search history.

(56) References Cited

U.S. PATENT DOCUMENTS 1,669,889 A 5/1928 Andrews et al.
1,821,862 A * 9/1931 Wilson ..... 277/591
2,170,443 A * 8/1939 Barbarou ..... 277/591
2,302,447 A 11/1942 King et al.
2,725,183 A 11/1955 Hanson
2,856,249 A * 10/1958 Leman ..... 92/171.1
3,606,361 A * 9/1971 Pohl et al. ..... 277/601
3,744,261 A 7/1973 Lagodmos
3,839,946 A 10/1974 Paget (Continued)

FOREIGN PATENT DOCUMENTS

EP 0523665 A1 1/1993

(Continued)

OTHER PUBLICATIONS

Parker Hannifin Corporation; 5700 Handbook; undated; pp. 5-22 and 5-23; Lexington, Kentucky.

(Continued)

*Primary Examiner*—Michael Koczo, Jr.
(74) *Attorney, Agent, or Firm*—Barnes & Thornburg LLP; James B. Conte

(57) ABSTRACT

A compact opposed piston pump minimizes axial spacing between its pistons on the drive shaft and thereby reduces the shaking couple and noise from reciprocation. Each piston has its own eccentric element press-fit into the connecting rods so as not to occupy space between the pistons. The shaking couple can be further reduced for pistons of different masses by selecting the mass of the eccentrics to compensate for the difference in piston masses. The pump also includes an improved cylinder sealing arrangement having a circumferential groove in an angled surface at the end of the cylinder. The pump also has a special two piece cover and seal for closing the open neck of the pump crankcase and an improved multi-lobed valve stop. The pump further uses tubular transfer members for transferring intake and/or exhaust air into the crankcase and/or between valve heads.

5 Claims, 12 Drawing Sheets

U.S. PATENT DOCUMENTS

| | | | | |
|---|---|---|---|---|
| 3,998,571 | A | | 12/1976 | Falke |
| 4,073,221 | A | | 2/1978 | Goloff |
| 4,190,402 | A | | 2/1980 | Meece et al. |
| 4,319,498 | A | | 3/1982 | McWhorter |
| 4,479,419 | A | | 10/1984 | Wolfe |
| 4,929,157 | A | | 5/1990 | Steele et al. |
| 5,035,050 | A | | 7/1991 | Cowen |
| 5,456,287 | A | | 10/1995 | Leu |
| 5,515,769 | A | | 5/1996 | Basinski et al. |
| 5,879,145 | A | | 3/1999 | Baumgartner |
| 5,961,127 | A | * | 10/1999 | Onda ..... 277/598 |
| 6,036,194 | A | * | 3/2000 | Stamper ..... 277/595 |
| 6,148,716 | A | | 11/2000 | Swank |
| 6,431,840 | B1 | | 8/2002 | Mashimo et al. |
| 6,832,900 | B2 | | 12/2004 | Leu |

FOREIGN PATENT DOCUMENTS

| | | |
|---|---|---|
| EP | 1150012 A2 | 10/2001 |
| EP | 1150012 A3 | 2/2004 |
| FR | 1156795 | 12/1956 |

OTHER PUBLICATIONS

European Search Report for Application No. 03029999.4-2315 PCT/.

Japanese Patent Abstract for Publication No. 05044647 entitled Discharge Vale Device for Reciprocating Compressor.

Brochure "Standard Product Catalog" Rietschle Thomas (2005).

* cited by examiner

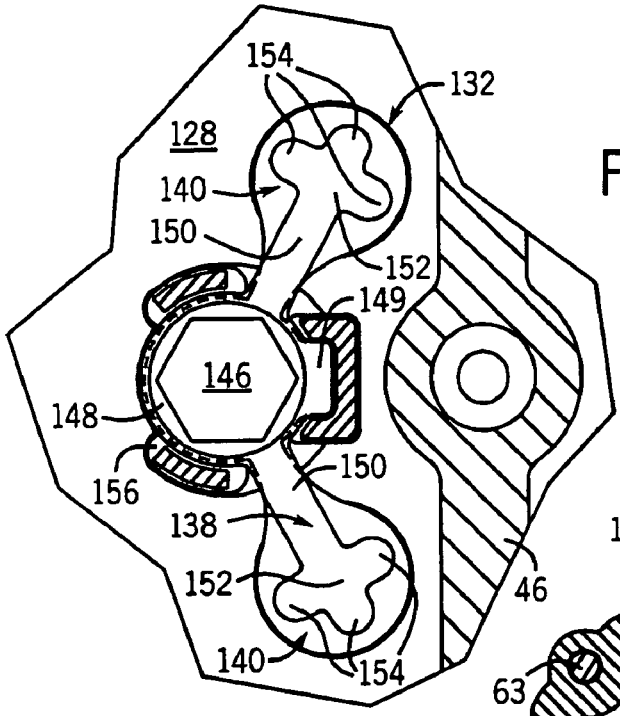
FIG. 13
FIG. 14
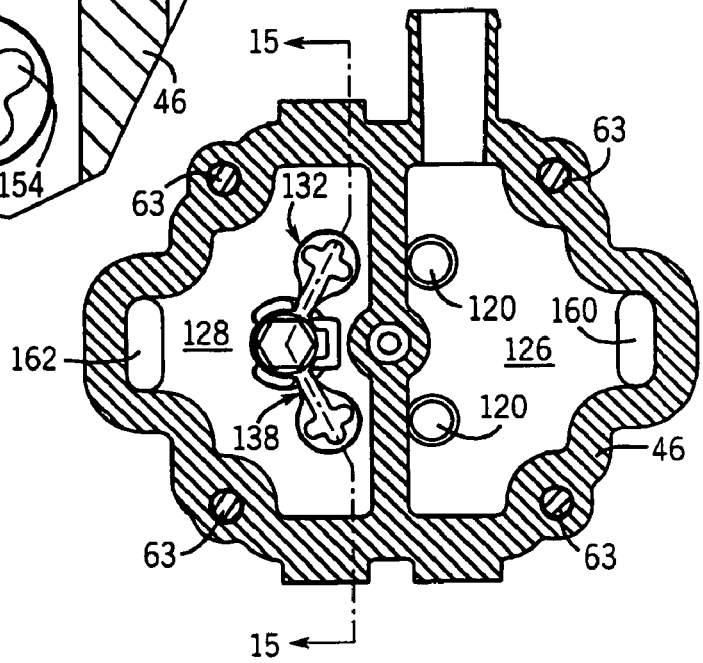
FIG. 15
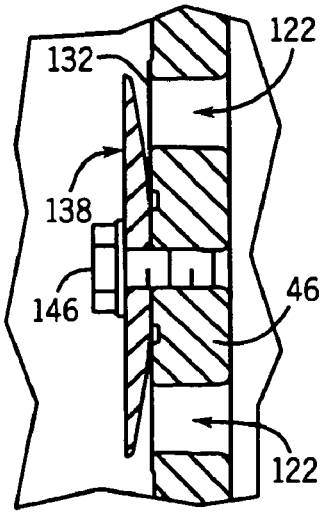
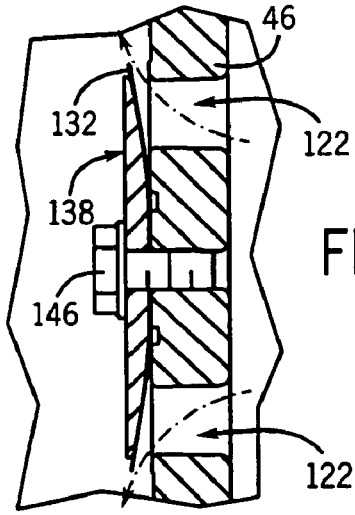
FIG. 16

FIG. 24
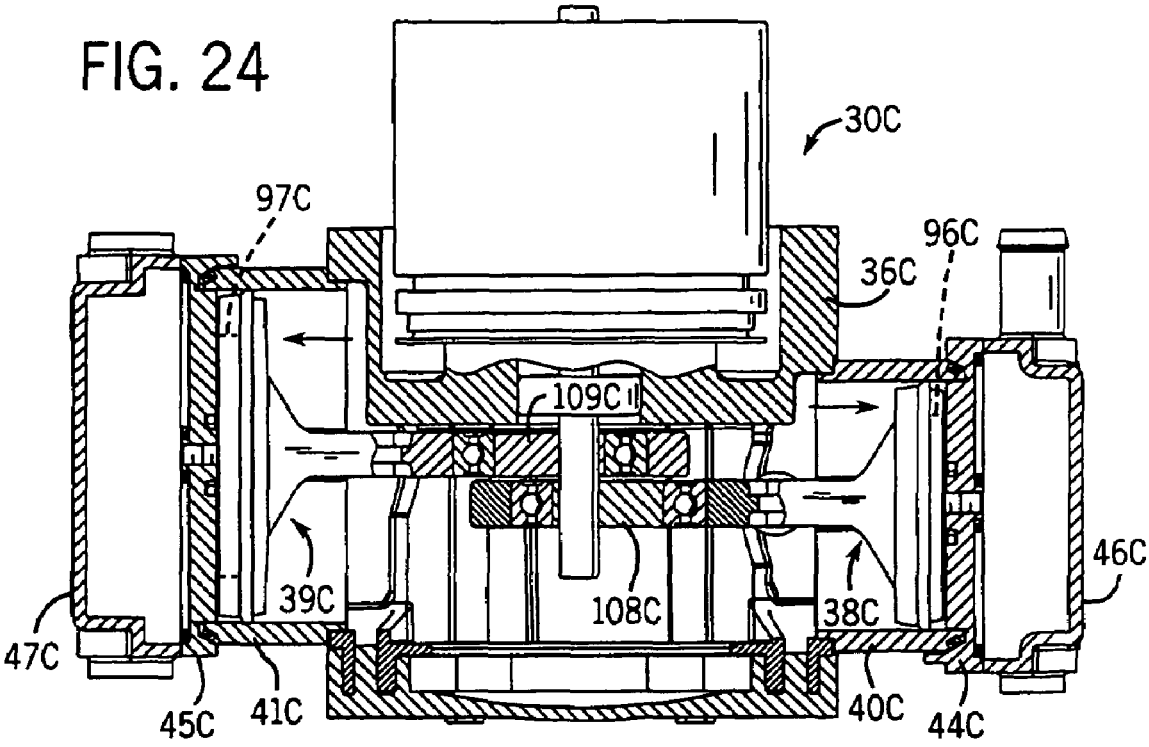
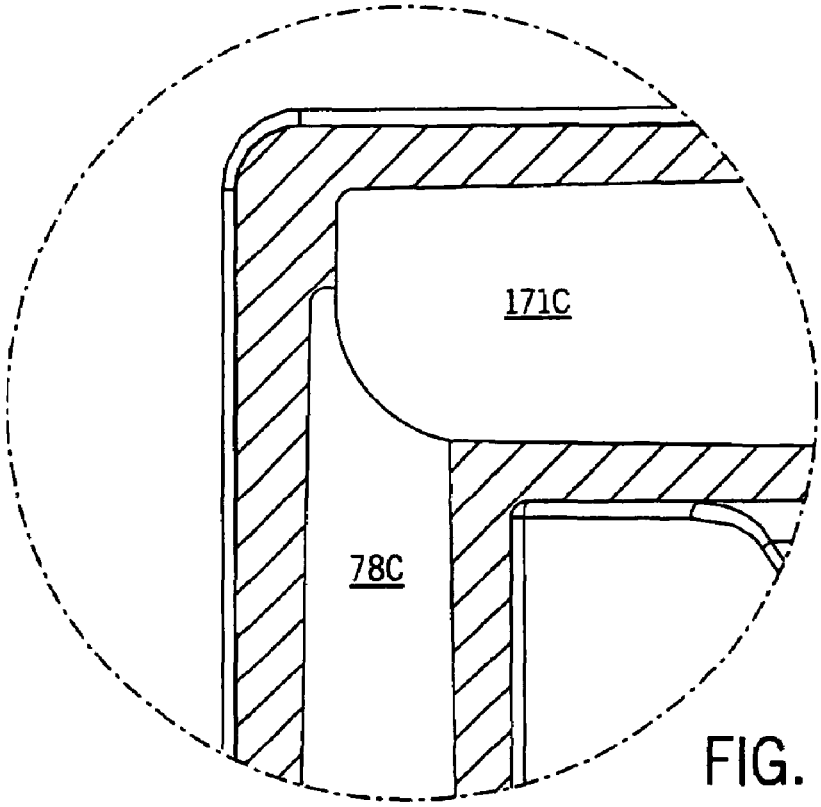
FIG. 25

PUMP CYLINDER SEAL

CROSS-REFERENCE TO RELATED APPLICATION

This is a divisional of U.S. patent application Ser. No. 10/338,950 filed Jan. 8, 2003, now issued as U.S. Pat. No. 6,832,900.

STATEMENT OF FEDERALLY SPONSORED RESEARCH OR DEVELOPMENT

Not applicable.

BACKGROUND OF THE INVENTION

The present invention relates to pumps and in particular to compact piston pumps.

Pumps for medical applications, such as used in oxygen concentrators, generally need to be compact and quiet to operate indiscreetly in homes and hospitals. It is thus important to properly muffle the working air as wells as reduce vibration during operation of the pump.

One problem with conventional pumps is that they can create excessive noise and vibration as the piston(s) are reciprocated, especially if they are improperly balanced. One reason for this in opposed piston pumps is that the pistons may be coupled to the drive shaft by a single retainer or eccentric element between the connecting rods of the piston. Ordinarily, an eccentric element is mounted to the drive shaft and two nibs or bosses extend axially from each side of the eccentric element to mount the pistons to the drive shaft. A moment, or shaking couple, arises as the drive shaft is turn because of the axial spacing between the pistons.

Another problem with conventional pumps is sealing the crankcase and cylinder(s). Improper sealing of the cylinders to the crankcase or the valve head(s) can cause pressurized air to leak to the outside of the pump, which both reduces pumping efficiency and makes noise. Typical sealing arrangements are either prone to leakage or require costly machining operations on the valve plate. Also, many crankcases are make with open necks to allow the pistons to be slid into the crankcase easily during assembly. Typically, the openings in the neck terminate at the cylinders, which have curved exterior surfaces. This makes sealing the crankcase difficult and typically requires separate seals in addition to that sealing the end of the crankcase, thus increasing assembly complexity and creating a potential leak path between the neck seals and the end seal.

Another problem with conventional pumps is that the valve stops can create excessive noise during operation. Typically, thin flapper valves are used to control the intake and exhaust ports of the valve heads. Because of the exhaust port opens under the force of the compressed air, a valve stop is used to support the valve and prevent it from being hyper-extended beyond its elastic range. Usually the stops have undersides that ramp up from the valve plate to support the tip of the valve farther from the valve plate than the neck of the valve. The valves are usually metal and the stops can be metal or plastic, however, in either case the rapid contact between the two surfaces can generate tapping or clicking sounds that are unacceptable in medical applications. Another problem here is that the thin flat flapper valve can succumb to surface attraction between the flapper and the stop and essentially "stick" to the stop and thus remain open.

Yet another problem confronting the design of low-noise pumps is properly muffling the intake and/or exhaust chambers of the valve heads. This can be done by attaching a muffler element to the valve head either direction or via suitable hoses. Another technique is to run the exhaust air into the crankcase on the non-pressure side of the piston head. In this case, if the crankcase is closed and the pistons are in phase, the crankcase will usually be vented through a muffler to avoid generating pulsations in the pump. Even using the later technique, the valve heads are usually exhausted through hoses leading to the crankcase, which is vented through a muffler directly mounted to the crankcase or at the end of a hose.

Accordingly, an improved pump is needed which addresses the aforementioned problems.

SUMMARY OF THE INVENTION

The invention provides an assembly for a pump including a cylinder and a seal. The circular end of the cylinder defines a frusto-conical surface of a certain cone angle relative to the axis of the cylinder. The seal is provided at the surface to facilitate manufacturing, assembly and disassembly.

In a useful aspect, the assembly includes a valve plate having a circular recess defining a frusto-conical surface at an angle corresponding to the angle of the frusto-conical surface of the cylinder. The seal seats against the frusto-conical surface of the valve plate. The frusto-conical surface of the valve plate can also be easily cast in the manufacturing process, and helps avoid the cylinder becoming stuck to the valve plate.

These and other advantages of the invention will be apparent from the detailed description and drawings. What follows is a description of the preferred embodiments of the present invention. To assess the full scope of the invention the claims should be looked to as the preferred embodiments are not intended as the only embodiments within the scope of the invention.

BRIEF DESCRIPTION OF THE DRAWINGS

FIG. 13 is an enlarged partial cross-sectional view showing one valve assembly;

FIG. 14 is a cross-sectional view taken along line 14—14 of FIG. 7;

FIG. 15 is a cross-sectional view taken along line 15—15 of FIG. 14 with an exhaust side flapper valve closed;

FIG. 16 is a view similar to FIG. 15 albeit with the valve shown open;

FIG. 24 is a cross-sectional view similar to FIG. 23 albeit showing the pistons at top dead center; and FIG. 25 is a cross-sectional view taken along line 25—25 of FIG. 23.

DETAILED DESCRIPTION OF THE PREFERRED EMBODIMENTS

Figure 1:
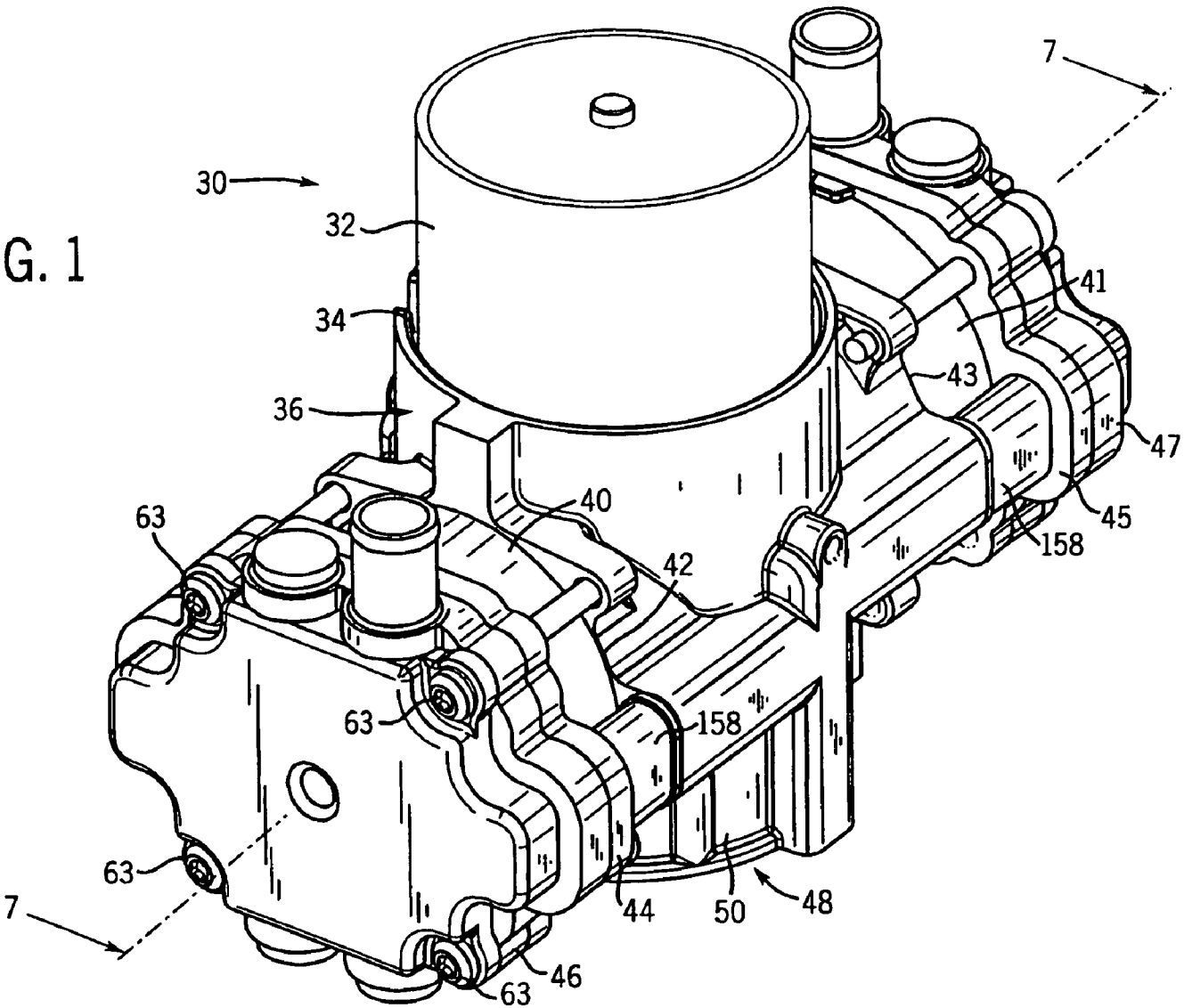
FIG. 1 is a perspective view an opposed piston pump of the present invention.

FIGS. 1–4 illustrate a pump 30 according to the present invention. Generally, the pump 30 has a motor 32 mounted in an inverted manner in a top opening 34 of a housing or crankcase 36 containing two piston assemblies 38 and 39. Two cylinders 40 and 41 are mounted to the crankcase 36 in respective side openings 42 and 43. Valve plates 44 and 45 and valve heads 46 and 47 are mounted to the outer ends of the respective cylinders 40 and 41. A cover/seal assembly 48 is mounted to the open neck 50 of the crankcase 36 over a bottom end opening 52 so that the interior of the crankcase is completely enclosed when the pump is assembled.

Figures 3, 4:
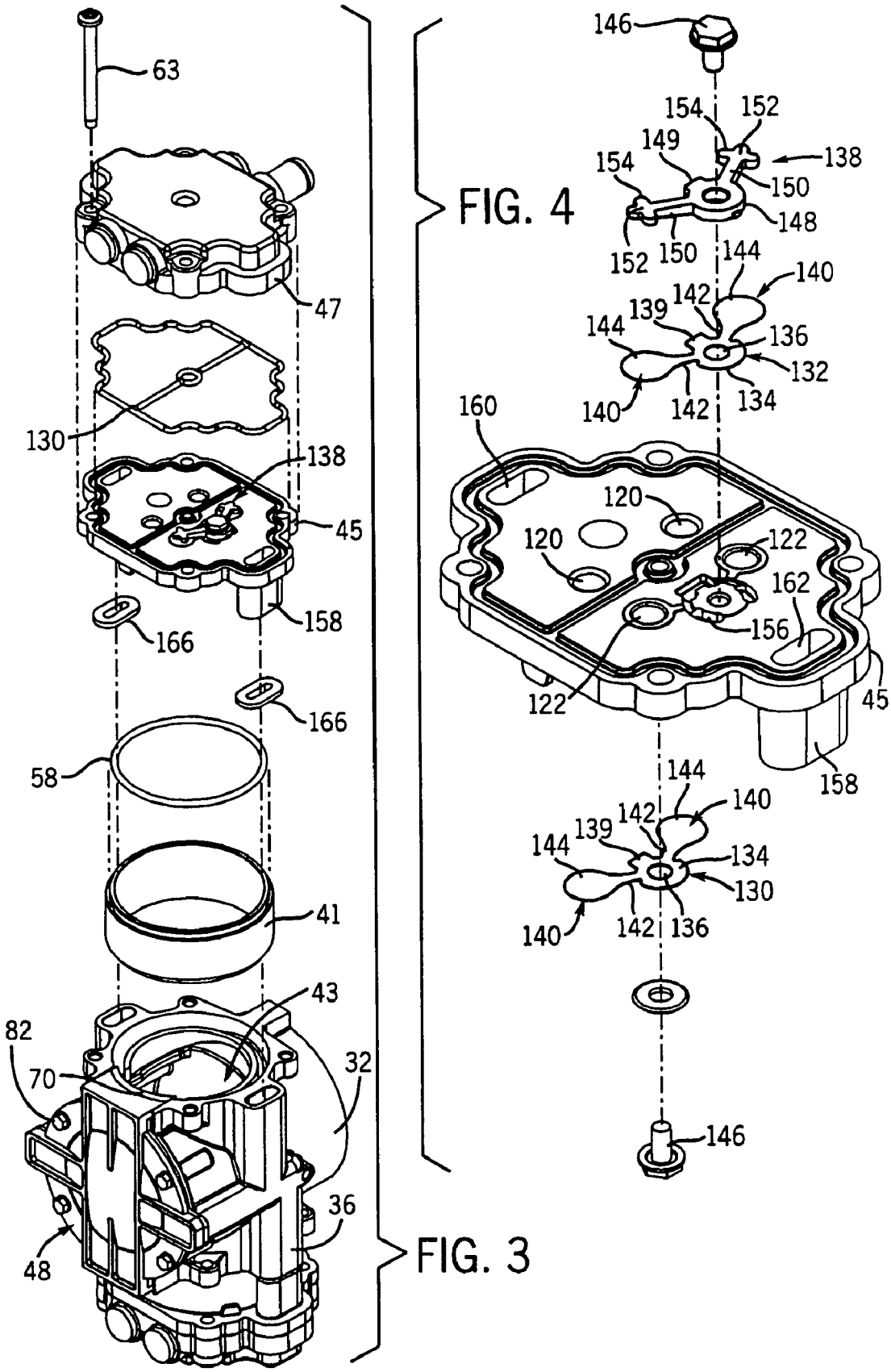
FIG. 3 is another perspective view of the pump showing one of its cylinder and valve head assemblies exploded.
FIG. 4 is an exploded perspective view showing one valve assembly in isolation.
Figure 5:
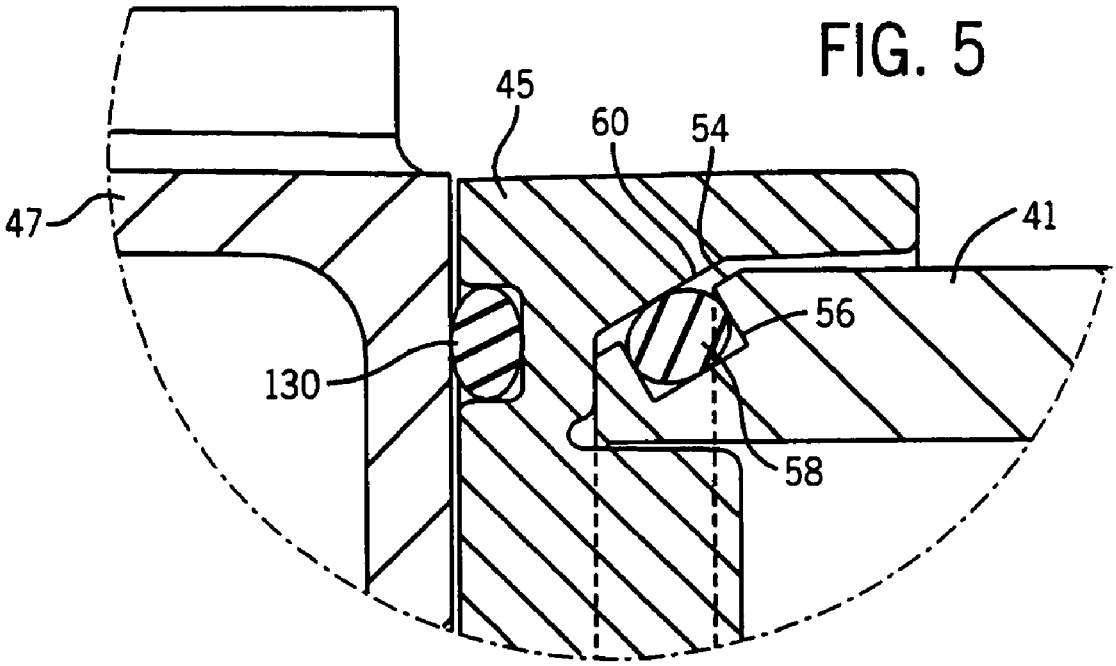
FIG. 5 is an enlarged partial cross-sectional view taken along arc 5—5 of FIG. 7 showing a cylinder seal in a circumferential groove in an angled end of the cylinder.

Referring to FIGS. 1, 3 and 5, more specifically, to improve the seal between the cylinders 40 and 41 and valve plates 44 and 45, the outer rims of each cylinder are tapered radially inward at a certain angle to define a frusto-conical surface 54 (one shown in FIG. 5) co-axial with the cylinder and having a circumferential groove 56 formed therein sized to a retain seal 58, preferably a resilient o-ring. Each of the valve plates 44 and 45 have an underside with a correspondingly angled frusto-conical surface 60 against which the seal 58 seats when the pump is assembled. The cylinders 40 and 41 are clamped to the crankcase 36 by fasteners 63 connecting the valve heads 46 and 47 to the crankcase 36 which compresses the seals between the grooves and the respective seats of the valve plates. This assembly provides a good seal as well as promotes serviceability in that the angled surfaces reduce the occurrence of the o-ring sticking to the valve plate over time and locking the valve plate to the cylinder. Also, the inwardly angled seat can be formed during casting of the valve plate without the need for additional machining.

Figure 2:
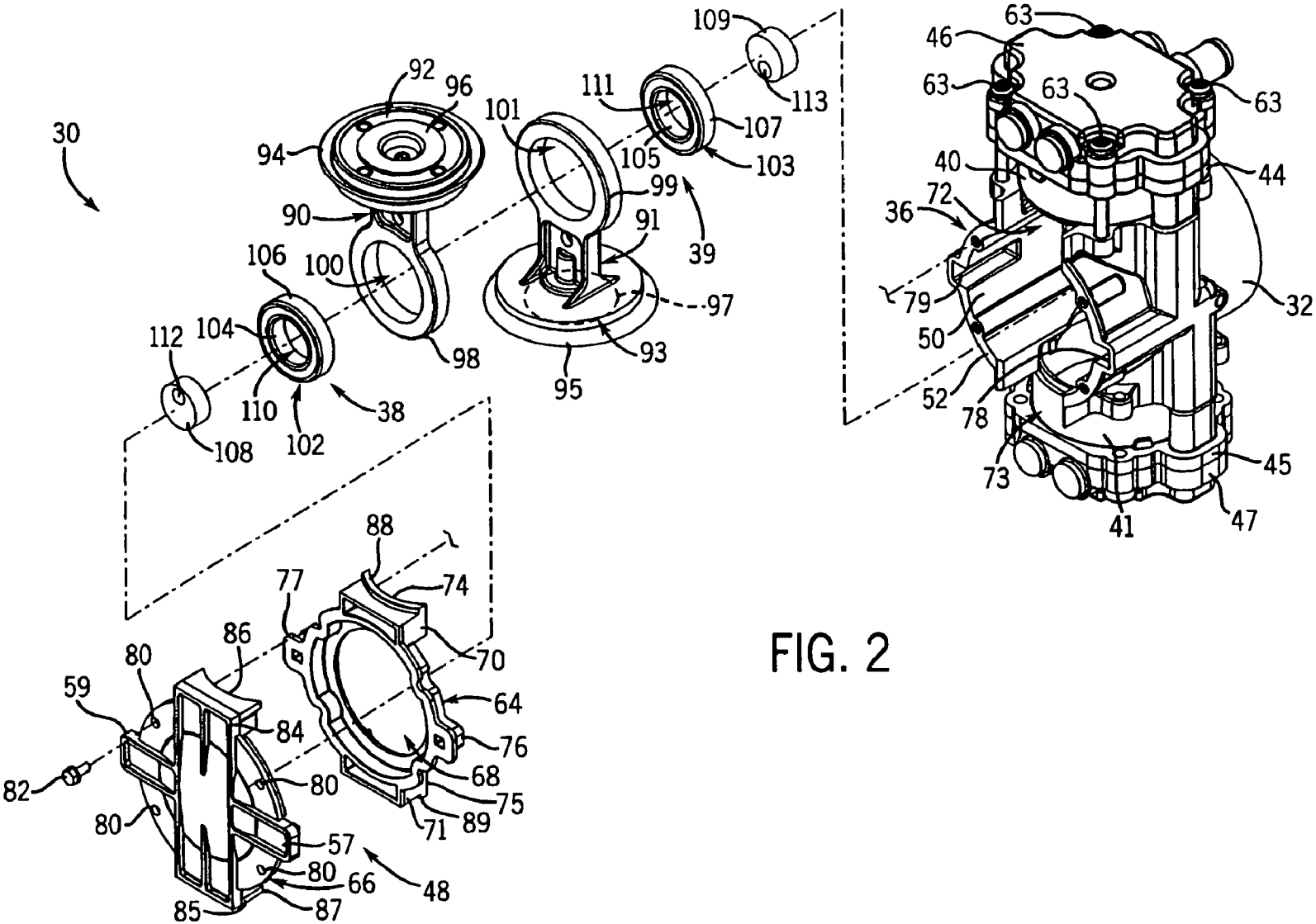
FIG. 2 is a perspective view of the pump showing its piston assemblies exploded.
Figure 6:
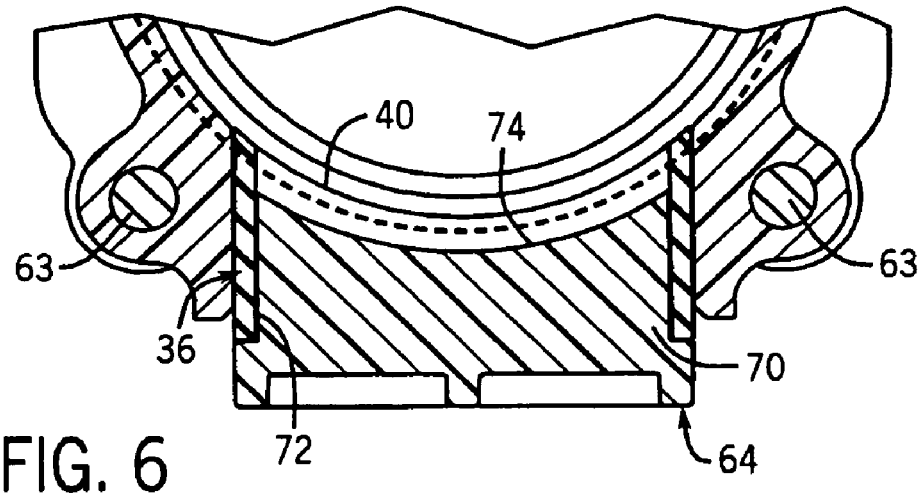
FIG. 6 is an enlarged partial cross-sectional view taken along line 6—6 of FIG. 7 showing an assembly for sealing the open neck of the pump housing.

Referring to FIGS. 2 and 6, the cover/seal assembly 48 improves the seal at the bottom opening 52 and open neck 50 of the crankcase 36. The unique cover/seal assembly 48 includes a resilient seal 64 and a rigid backing plate 66. In particular, the seal 64 is a generally ring shaped structure defining a central opening 68 and sized to fit onto the open end 52 of the crankcase 36. The seal 64 defines two axially extending neck plugs 70 and 71 at opposite locations on the ring, for example at the 12 and 6 o'clock positions. The neck plugs 70 and 71 are sized and shaped to fit into the openings 72 and 73 in the neck 50 of the crankcase 36. The neck plugs 70 and 71 define concave sealing surfaces 74 and 75 shaped to fit against the convex contour of the outside of the cylinders 40 and 41. The sealing surfaces 74 and 75 have pointed ends that fit snugly against the intersecting surfaces of the neck 50 and the cylinders 40 and 41 (see FIG. 6). The seal 64 also defines two port plugs 76 and 77 extending radially outward from the ring at the 3 and 9 o'clock positions. These port plugs 76 and 77 fit into the end of passageways 78 and 79 formed in the crankcase 36 (as discussed below). The seal 64 is retained by the backing plate 66, which is generally a circular plate with four openings 80 through which four fasteners 82 are disposed to fasten the cover/seal assembly 48 to the crankcase 36. The backing plate 66 has axially extending plug supports 84 and 85 aligned with the neck plugs 70 and 71 with curved edges 86 and 87 contacting ledges 88 and 89 defined by the neck plugs 70 and 71. The backing plate 66 also has two tabs 57 and 59 located and sized to support respective port plots 76 and 77 of the seal 68.

The plug supports 84 and 85 help maintain the seal of the neck plugs 70 and 71. However, the pointed corners of the neck plugs 70 and 71 can flex away from the crankcase and cylinders somewhat to allow a leak path to relieve transient high pressure situations. The seal is designed primarily for low pressure applications to seal off air leaks for noise reductions. The corners of the neck plugs will unseat slightly when the internal pressure reaches about 15 psi as a pressure relief. The assembly could, of course, be used in higher pressure applications by using a more rigid elastomer or modifying the backing plate to prevent the seal from unseating.

Referring to FIG. 2, the piston assemblies 38 and 39 each include pistons 90 and 91 and with heads 92 and 93, having pistons seals 94 and 95 mounted by retainers 96 (one shown), and connecting rods 98 and 99 defining circular openings 100 and 101, respectively. Bearings 102 and 103 (having inner races 104 and 105 rotatable with respect to outer races 106 and 107, respectively) press-fit into the respective openings 100 and 101 to fix the outer races to the connecting rods 98 and 99. Circular eccentric elements 108 and 109 are then press-fit into respective openings 110 and 111 of the bearings to fix them to the respective inner races 104 and 105. The eccentric elements 108 and 109 have through bores 112 and 113 radially offset from their centers.

Referring to FIGS. 7, 8, 11 and 12, the piston assemblies 38 and 39 are press-fit onto a drive shaft 114 of the motor 32 one at a time in the through bores 112 and 113 of the eccentric elements 108 and 109, respectively. The drive shaft 114 is journalled to the crankcase 36 by bearing 116. The crankcase openings 42 and 43 and cylinders 40 and 41 are offset somewhat to account for the different axial locations of each piston assembly 38 and 39 so that piston 90 reciprocates along the centerline of cylinder 40 and piston 91 reciprocates along the centerline of cylinder 41 allowing the piston seals 94 and 95 of each assembly creating a sliding seal with the inner surfaces of the cylinders.

Importantly, the connecting rods 98 and 99 of the pistons 90 and 91 are mounted on the drive shaft 114 so that the connecting rods 98 and 99 are substantially adjacent one another, that is within ⅛ inches (preferably less than 1/16') or as close as possible. Preferably, the pistons are mounted on the drive shaft as close as possible with only air space between the connecting rods. This is to reduce the moment or shaking couple about the drive shaft 114 caused by the axial displacement of the piston assemblies 38 and 39. While some moment remains, this arrangement provides a significant improvement over the prior art in that there is no other element (eccentric or otherwise) on the shaft between the pistons so that their axial displacement is minimized.

Figure 7:
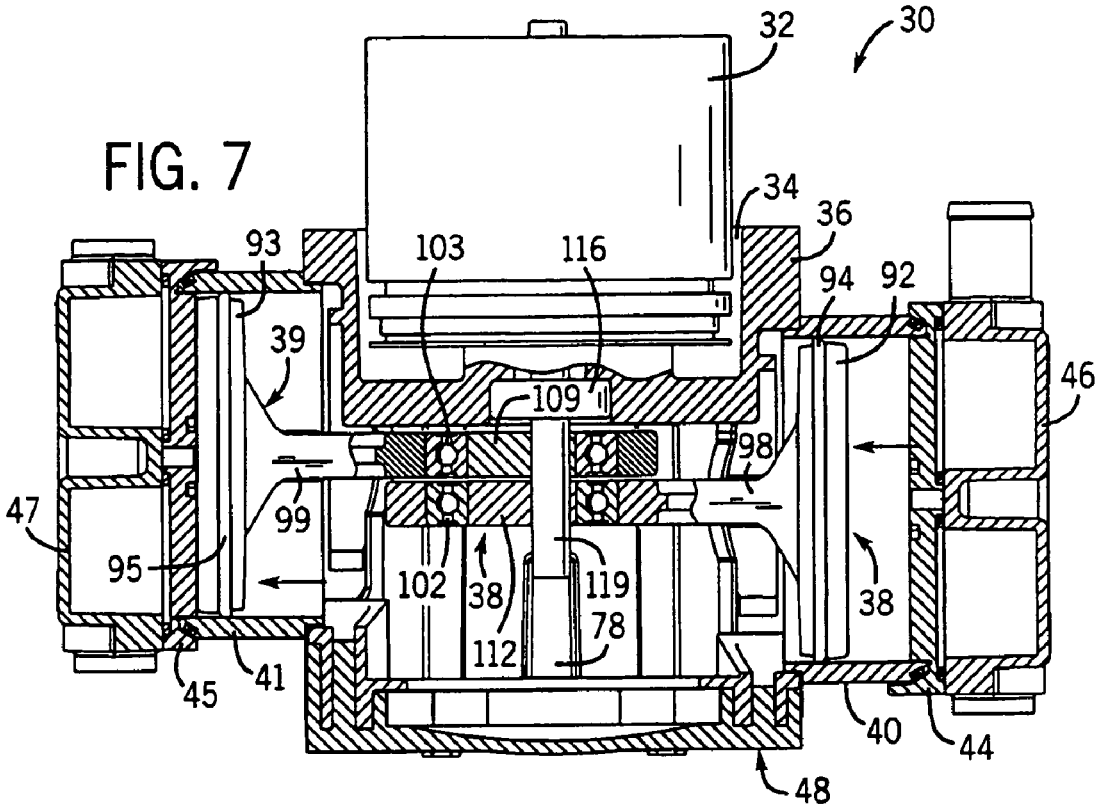
FIG. 7 is a cross-sectional view taken along line 7—7 of FIG. 1 showing the pump (without the intake and exhaust valves) with its pistons 180° out of phase and one piston at top dead center and the other at bottom dead center and with the valve heads coupled.
Figure 8:
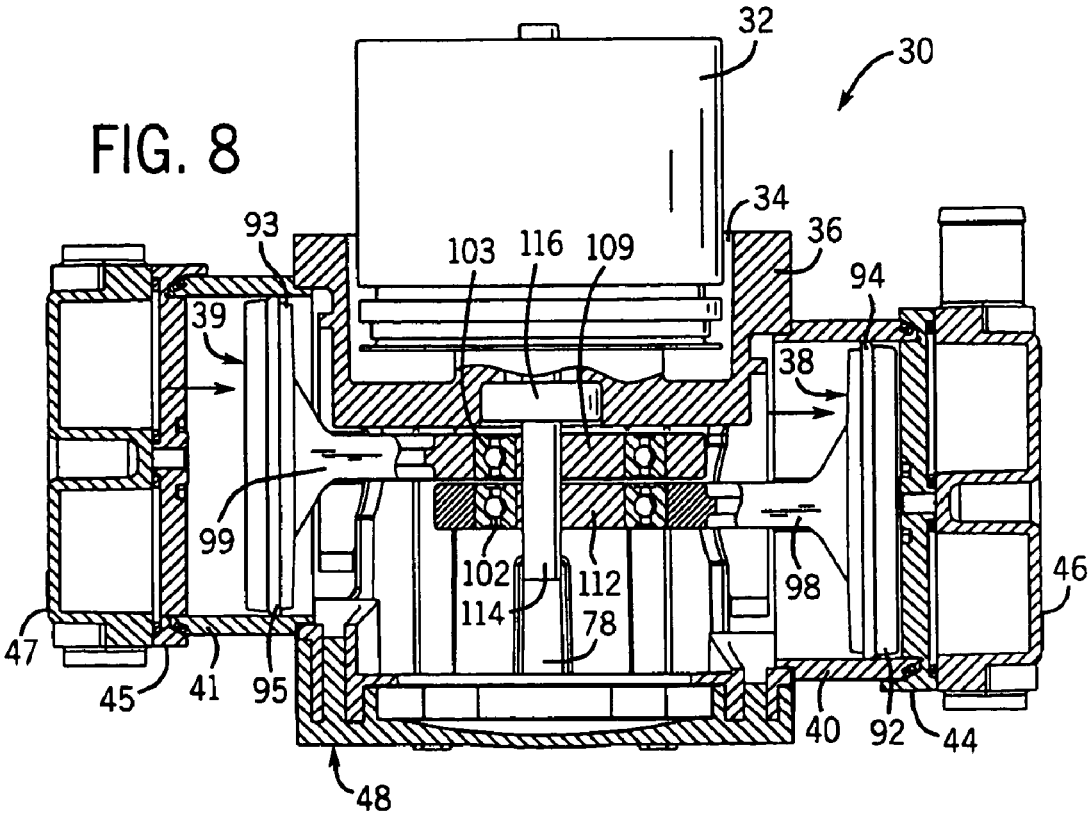
FIG. 8 is a cross-sectional view similar to FIG. 7 albeit with the pistons in a position 180° from that of FIG. 7.

As shown in FIGS. 7 and 8, the pump 30 can operate as a parallel pressure or parallel vacuum pump in which the pistons reciprocate 180 degrees out of phase. FIG. 5 shows piston 90 at top dead center while piston 91 is at bottom dead center. FIG. 6 shows the pistons when the drive shaft is rotated 180 degrees so that piston 90 is at bottom dead center when piston 91 is at top dead center. This configuration of the pump results from the eccentric elements 108 and 109 being mounted to the drive shaft 114 so that the through bores 112 and 113 in positions opposite 180 degrees with respect to their pistons. For example, the through bore 112 would be at a 12 o'clock position (toward the piston head) and the through bore 113 would be at a 6 o'clock position.

Figure 9:
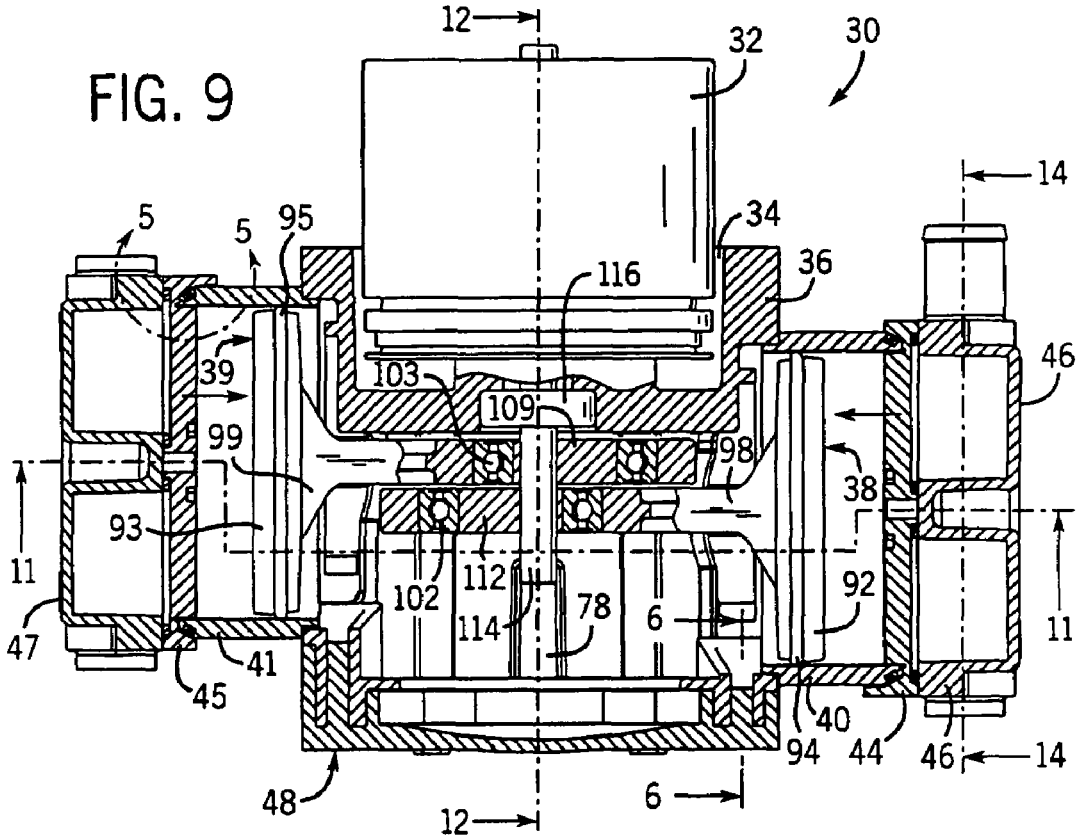
FIG. 9 is a cross-sectional similar to FIG. 7 showing the pump with its pistons in phase at bottom dead center and with one valve head exhausted to the crankcase and the other exhausted to the load.
Figure 10:
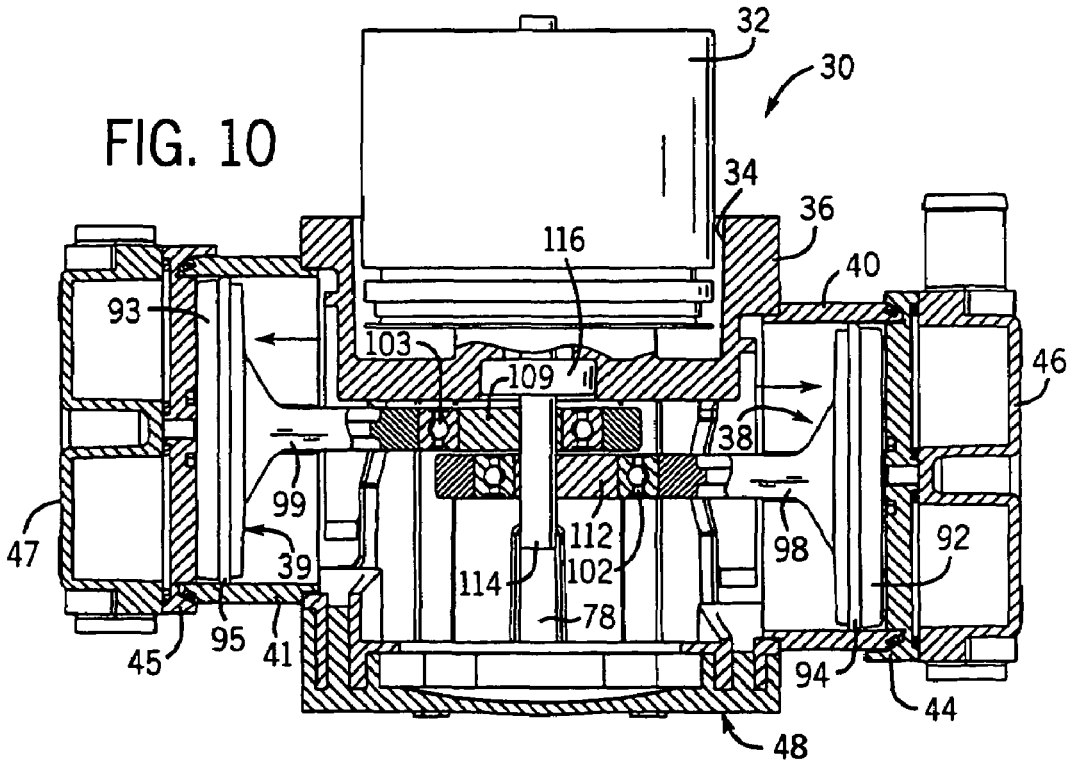
FIG. 10 is a cross-sectional view similar to FIG. 9 albeit showing the pistons at top dead center.
Figure 11:
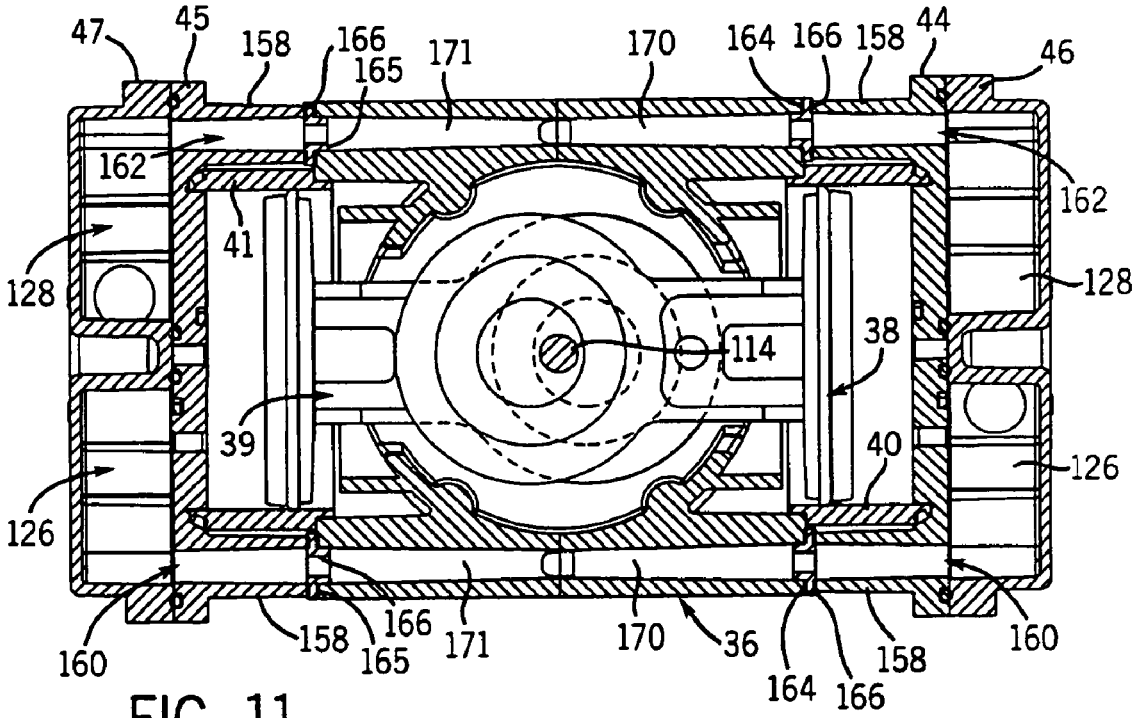
FIG. 11 is a cross-sectional view taken along line 11—11 of FIG. 7.
Figure 12:
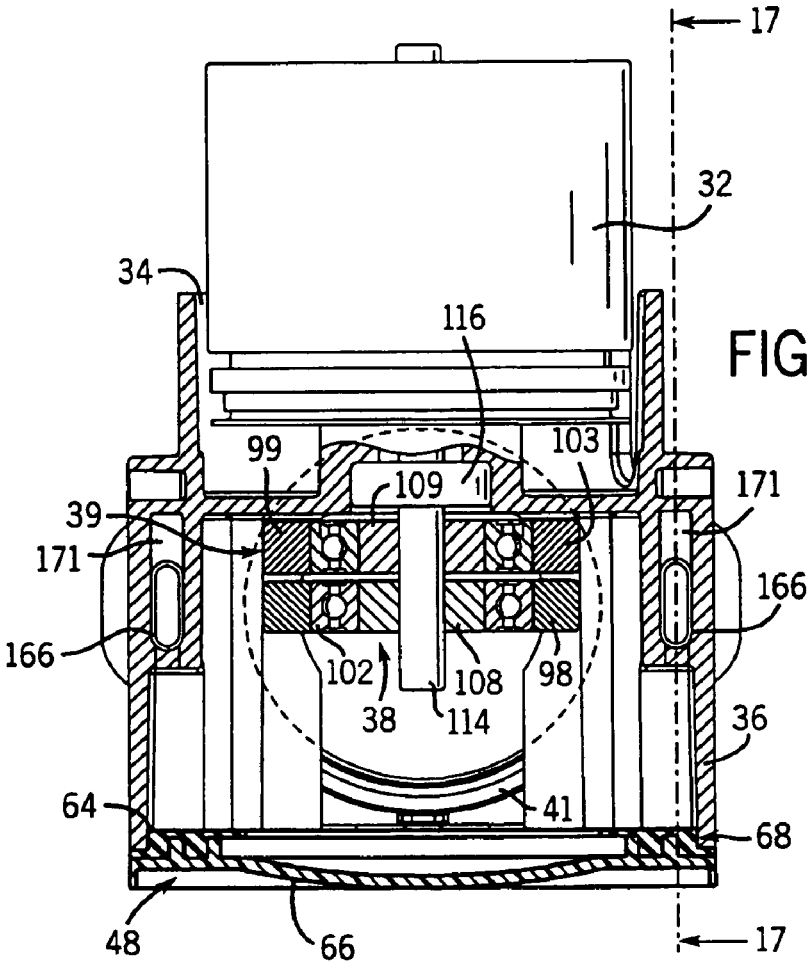
FIG. 12 is a cross-sectional view taken along line 12—12 of FIG. 7.
Figure 17:
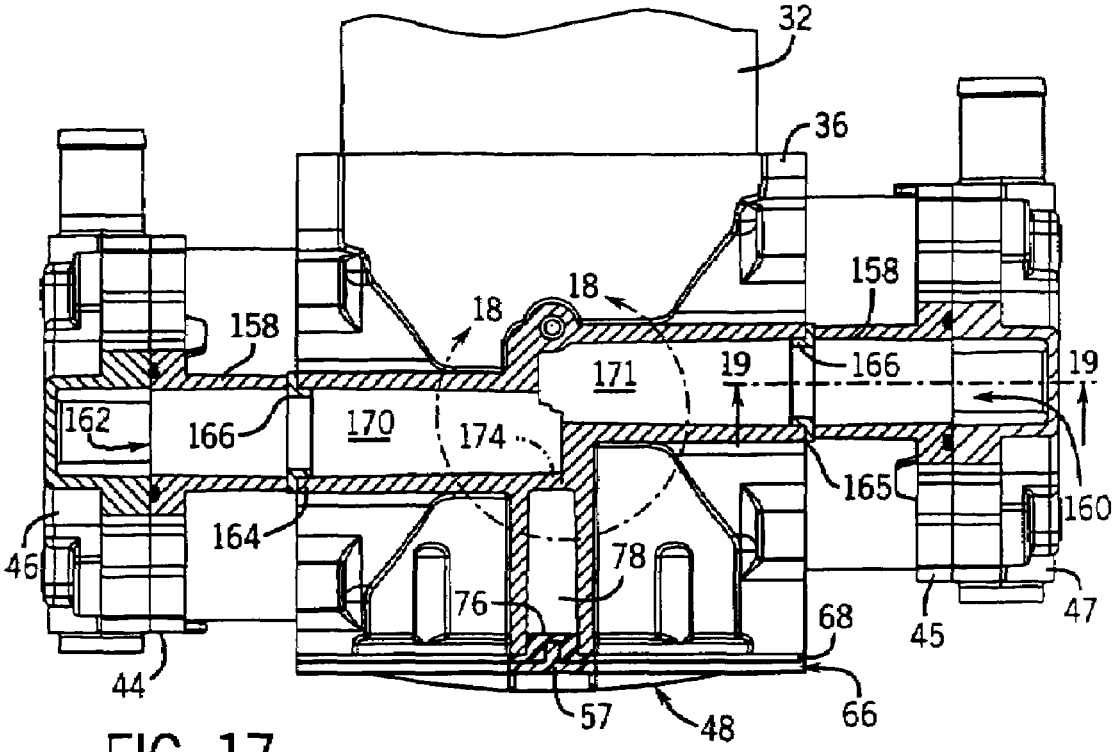
FIG. 17 is a cross-sectional view taken along line 17—17 of FIG. 12.
Figure 18:
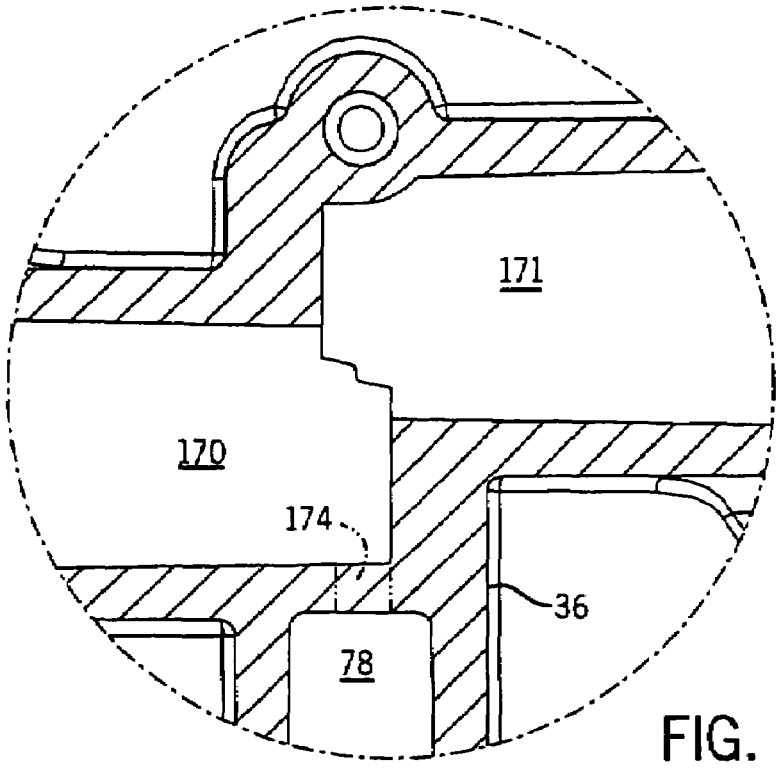
FIG. 18 is an enlarged partial cross-sectional view taken along arc 18—18 of FIG. 17.
Figure 19:
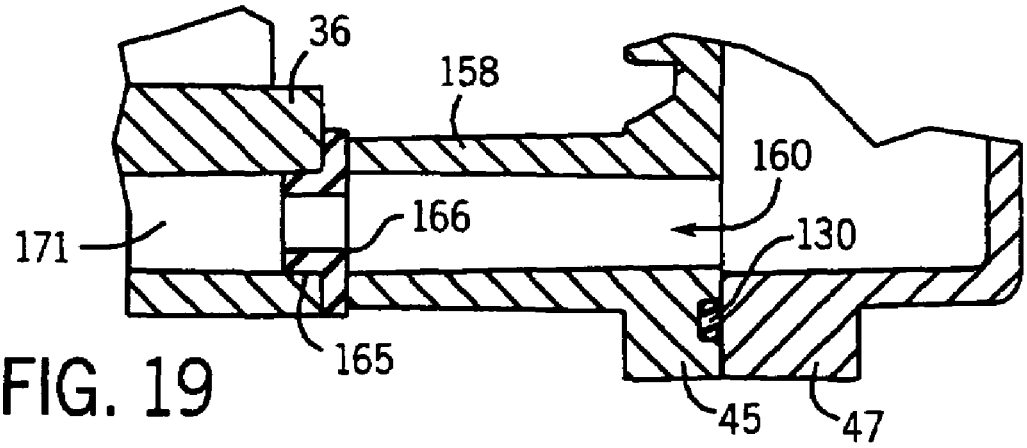
FIGS. 19–21 are enlarged partial cross-sectional view taken along line 19—19 of FIG. 17 showing various alternate constructions of a transfer tube.

FIGS. 9 and 10 show an alternate configuration in which the pump operates as a pressure-vacuum pump with the pistons reciprocating in phase (i.e., moving in and out of the cylinders in unison). In this case, the eccentric elements would be mounted to the drive shaft when both are in the same orientation with respect to their piston, for example, both through bores being at 12 o'clock. This version of the pump can be otherwise identical to that shown in FIGS. 1–4.

Air flow through the cylinders is controlled by the valving on the valve plates 44 and 45. Referring to FIGS. 3, 4, and 13–16, the valve plate 44 includes pairs of intake ports 120 and exhaust ports 122. The pairs of intake 120 and exhaust 122 ports are separated by a partition 124 of the valve head 46 defining two intake 126 and exhaust 128 chambers. A specially shaped head seal 130 lies between the valve plate 44 and the valve head 46 to seal and isolate the two chambers 126 and 128.

The intake 120 and exhaust 122 ports are controlled by respective flapper valves 130 and 132. The flapper valves 130 and 132 are identically shaped thin, metal valves. The valves 130 and 132 each have a middle section 134 defining an opening 136 and an alignment tab 139 as well as two identical paddles 140 extending from the middle section 130 in opposite directions approximately 30 degrees from vertical. The paddles 140 have narrow necks 142 and relative large flat heads 144. The heads are sized slightly larger than the intake and exhaust ports and the necks are narrow to let the valves flex more easily under the force of the pressurized air, and thus reduce power consumption. Each flapper valve 130 and 132 is mounted to the valve plate 44 by a fastener 146 inserted through the opening 136 in the middle section 134 of the valve and threaded into bores in the valve plate. The intake valve 130 is mounted at the inside of the cylinder 40 and the exhaust valve 132 is mounted in the exhaust chamber 128.

Referring to FIGS. 4 and 13–16, because the exhaust valve 132 opens under the force of the compressed air in the cylinder, it is backed by a valve stop 138 preferably made of a rigid plastic. No valve stop is needed for the intake valve which opens during the expansion stroke. In particular, the valve stop 138 has a middle body 148 with an alignment tab 149 and an opening therethrough for the fastener 146. Two arms 150 extend out from the body 148 at the same angles as the valve paddles 140. Two hands 152 have fingers or lobes 154, preferably three, extending outward and spaced apart at equal angles. The underside of the arms 150 and hands 152 tapers away from the valve plate, preferably with a slight convex curve, so that the lobes 154 are spaced away from the valve plate 44 enough to allow the valve paddles 140 to move sufficiently to open the ports. As shown in FIG. 16, the paddles follow the contour of the underside of the arms and lobes when opened and are supported along their entire length (except at the tips). The arms 150 are approximately the width of the valve paddle necks 142 and the lobes 154 are sized to support the entire paddle heads 144 to prevent them from hyper-extending at the narrow necks. Collectively, the underside of the lobes 154 are of less surface area than the paddle heads 144 and end inside of the boundaries of the heads. This design limits the surface contact between the paddles and the stop which has two main advantages: first, it reduces the surface attracting forces or "stiction" between these elements which could cause the valves to stick to the stop and remain open, and second, it reduces vibration in the valves that would otherwise be present were the valve tips contact the stops. This design may also serve to reduce or eliminate valve chatter. It should also be noted that the valves are mounted to the valve plates with their middle sections disposed over recesses 156 shaped like the middle sections only larger. This allows the valves to be assembled and aligned by a fixture having pins that extend below the underside of the valves and into the recesses 156. The alignment tabs 139 and 149 ensure that the valve and stop are in the proper orientation.

Figure 20:
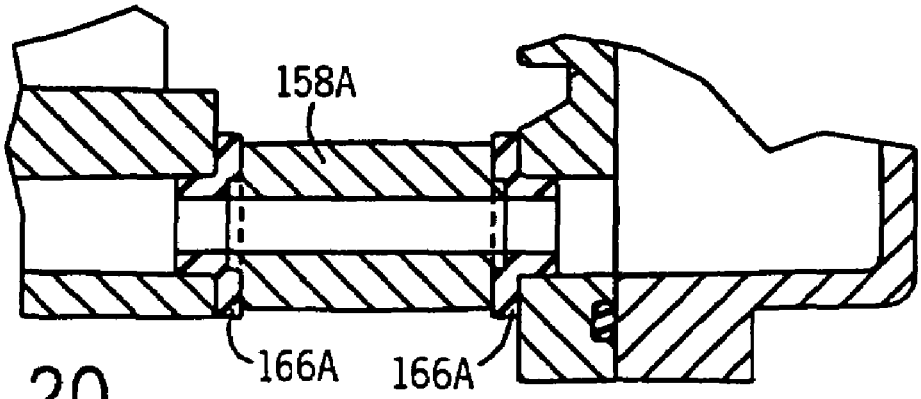
Figure 21:
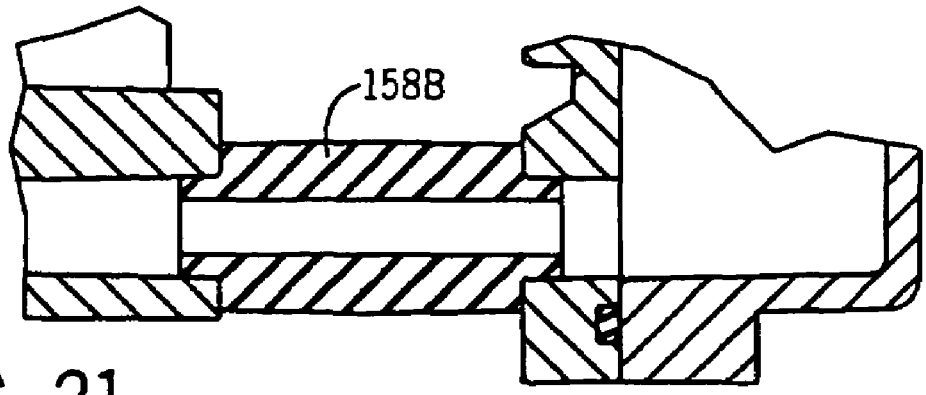
Figure 22:
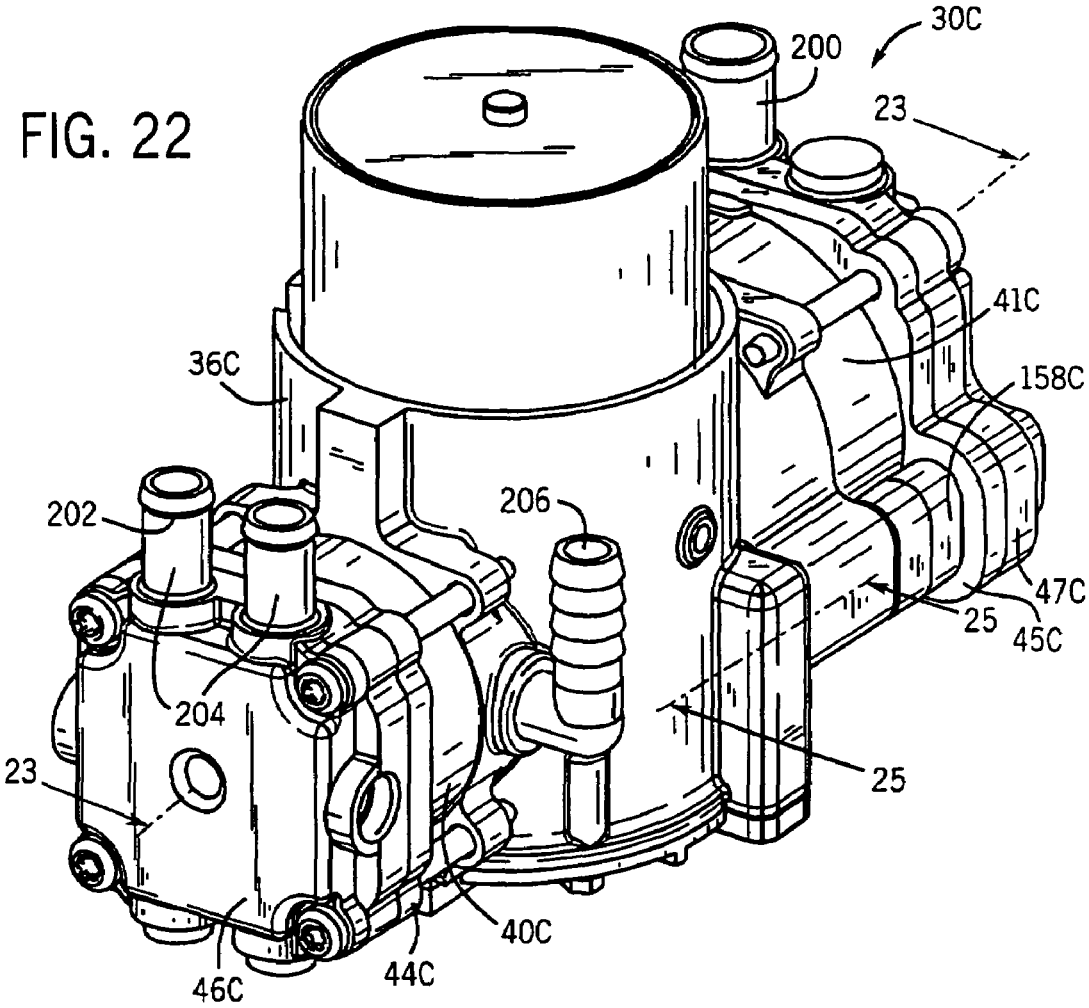
FIG. 22 is a perspective view of an alternate embodiment of the pump of the present invention with different sized cylinders and pistons.

Another feature of the pump 30 is the use of transfer tubes 158 with air passageways formed in the crankcase 36 to either couple one exhaust chamber to the inside (non-pressure side) of the crankcase or to couple the valve heads together (in parallel between exhaust chambers and/or between intake chambers or in series with the exhaust chamber of one valve head connected to the intake chamber of the other valve head) without the need for hoses. Referring now to FIGS. 11, 12 and 17–21, the pump 30 includes small tubular members 158, preferably having two opposite flat sides, extending from intake 160 and exhaust 162 transfer ports through the valve plates outside of the cylinders. In one preferred form, these transfer tubes 158 are formed as a unitary part of the valve plates (see FIGS. 17 and 19). The free ends of the transfer tubes 158 are coupled to two sets of transfer openings 164 and 165 in the crankcase 26 preferably with a special resilient seal 166 therebetween having a flange 168 that fits inside the transfer openings 164 and 165 in the crankcase. It should be noted that the transfer tubes need not be integral with the valve plates but instead could be as shown in FIGS. 20 and 21 in which they are entirely separate elements. In FIG. 20, each transfer tube 158A is a separate rigid member with (or without) stepped ends mounting resilient seals 166A. Or, as shown in FIG. 21, each transfer tube 158B could be made of a entirely of a resilient material so that no separate seals are needed. Preferably, it would have stepped ends that fit inside the corresponding openings in the crankcase and valve plate.

As mentioned, the crankcase 36 has two sets of interior passages 170 and 171 in the walls of the crankcase opening at the transfer openings 164 and 165. Depending on the desired operation of the pump, there can be only one of these passageways 170 and 171 or one set of these passageways in one side of the crankcase. One or both of these passages may also open to the passages 78 and 79, which open to the interior of the crankcase. This can be done by boring through section 174 or by casting the crankcase to block off or connect passageways as needed. In the parallel pressure embodiment of the pump shown in FIGS. 11, 17 and 18, preferably the passageways 170 and 171 couple the exhaust chambers of each valve head and the intake chambers of each valve head. In this way, the load can be connected at a hose barb or socket of either of the intake chambers (to pull a vacuum) or either of the exhaust chambers (to provide pressure) or both, without connecting to both of the intake chambers and/or exhaust chambers. A suitable muffler (not shown) can be connected to either the intake or exhaust side if not otherwise connected to a load.

Figure 23:
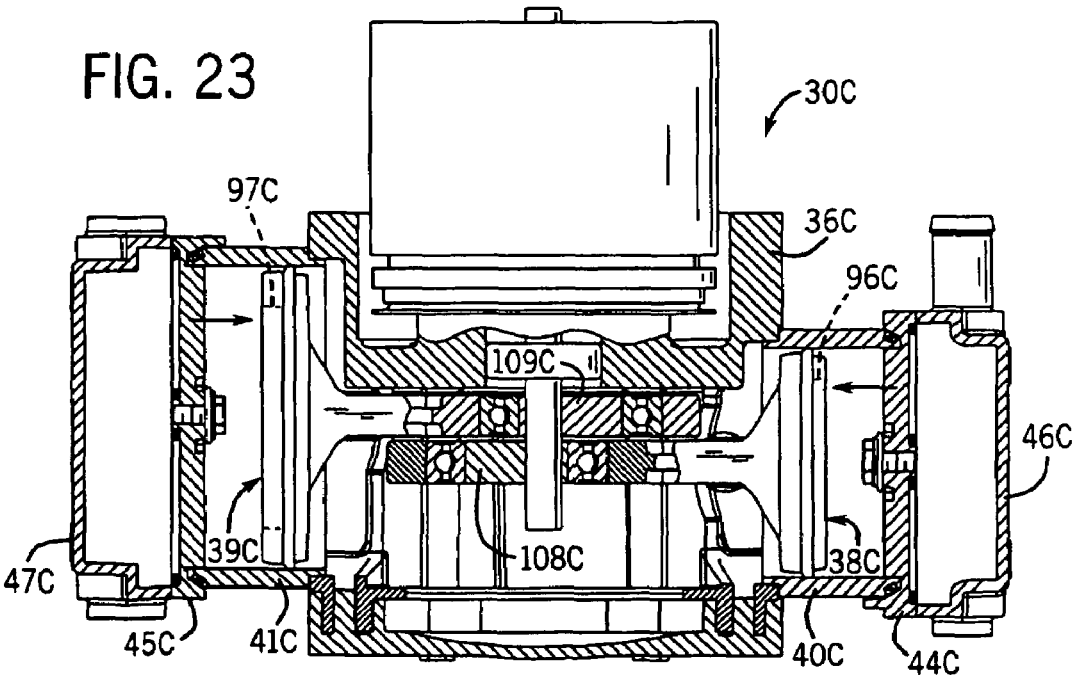
FIG. 23 is a cross-sectional view taken along line 23—23 of FIG. 22 showing the pump (without the intake and exhaust valves) operating as a pressure-vacuum pump with its pistons in phase at bottom dead center and with the larger valve head exhausted to the crankcase.

FIGS. 22–25 show another preferred pressure-vacuum embodiment of the pump 30C such as can be used in a medical application, such as an oxygen concentrating apparatus. This embodiment of the invention is identical to that described above, with the following exceptions. Here, cylinder 40C, valve plate 44C, valve head 46C and the head of piston assembly 38C are of a lesser size (diameter) than cylinder 41C, valve plate 45C, valve head 47C and the head of piston assembly 39C, respectively. Preferably, the smaller side is the pressure side and the cylinder 40C has a 1.5 inch diameter and the larger side is the vacuum side with the cylinder 41C having a 2 inch diameter. Preferably, in this embodiment, the piston assemblies 38C and 39C are in phase as shown in FIGS. 23 and 24 (although they could be out of phase as well), the pressure side providing roughly 9 psi of pressure and the vacuum side drawing a vacuum of about −7 psi, which is preferred for oxygen concentrator devices.

Since the pistons are of different sizes, they have different masses. The difference in masses will make the pistons out of balance and thus effect unequal moments on the drive shaft, which would cause vibration, noise and lower pump efficiency. Preferably, the eccentrics 108C and 109C are selected to have different masses, substantially equal to the difference in the piston masses. This can be accomplished by making the eccentrics from disparate materials or of different sizes (such as different diameters). For example, the eccentric 108C could be made of a suitable zinc composition so that it has a greater mass than eccentric 109C, which could be made of an aluminum. Thus, the heavier eccentric 108C would make of the difference in mass of the smaller piston 90C. The result is better balanced piston assemblies and improved operation of the pump when the application requires different flow volumes in the cylinders.

The pump also differs from that described above in that it has only one transfer tube 158C connecting the exhaust side of valve head 47C to passageway 171C (through a transfer opening) in the crankcase 36C. Passageway 171C intersects with passageway 78C (as shown in FIG. 25). The crankcase 36C has no other internal passageways as did the previously described embodiment.

This embodiment of the pump is thus constructed so that air can be drawn from the load (through a hose (not shown) connected to barb 200) and into the intake chamber of valve head 47C. Surrounding air can also be brought in through barb 202 (to which preferably a muffler (not shown)) is mounted. Air from the higher pressure side valve head 46C exhaust chamber will be exhausted through barb 204 to the load (after passing through hoses and valves as needed). The exhaust chamber of the vacuum side valve head 47C will exhaust through the transfer tube 158C and crankcase passageways 171C and 78C to the non-pressure side of the inside of the crankcase 36C, which is vented through barb 206 and another muffler (not shown). Passing the exhaust through the crankcase prior to the muffler provides further (two-stage) sound attenuation beneficial in low-noise applications, such as when used with medical devices.

It should be appreciated that preferred embodiments of the invention have been described above. However, many modifications and variations to these preferred embodiments will be apparent to those skilled in the art, which will be within the spirit and scope of the invention. For example, while only two-cylinder embodiments were shown, the principles of the invention could apply to a three, four or more cylinder pump such as a pump having multiple motors (or one double shafted motor) and additional crankcases, cylinders, pistons and valve heads. In this case, the valve heads of all three or more cylinders could be coupled in series or parallel through the transfer tubes and integral crankcase passages, like those described above. Shared valve heads for multiple cylinders could also be incorporated into such a pump. The pump of the present invention could also include transfer tubes which connect directly to the valve heads/plates to join air chambers without connected to passageways in the crankcase.

Therefore, the invention should not be limited to the described embodiments. To ascertain the full scope of the invention, the following claims should be referenced.

What is claimed is:

1. In a pump having a pumping chamber defined at least in part by a cylinder having an axis and a valve plate, said cylinder having an outer rim, said outer rim cooperating with said valve plate to seal said chamber, said outer rim tapered radially inward at an angle relative to said axis, wherein a groove is formed in said tapered outer rim.

2. In a pump having a pumping chamber defined at least in part by a cylinder having an axis and a seal at an end of the cylinder that seals the pumping chamber, the improvement wherein a frusto-conical surface is defined at said end of the cylinder at a certain cone angle relative to the axis of the cylinder and, wherein a groove is formed in said surface and said seal is provided in said groove.

3. The assembly of claim 2, wherein the seal is an o-ring.

4. In a pump having a pumping chamber defined at least in part by a cylinder having an axis and a seal at an end of the cylinder that seals the pumping chamber, the improvement wherein a frusto-conical surface is defined at said end of the cylinder at a certain cone angle to the axis of the cylinder and, further including a valve plate having a circular recess defining a frusto-conical surface at an angle corresponding to the angle of the frusto-conical surface at the end of the cylinder, said seal seating against said frusto-conical surface of said valve plate.

5. In a pump having a pumping chamber defined at least in part by a cylinder having a cylinder end cooperating with a valve plate in sealing said pumping chamber, the improvement wherein a frusto-conical surface is defined at said end of the cylinder at a certain cone angle relative to the axis of the cylinder and wherein a groove is provided in said surface.

* * * * *